United States Patent [19]

Beckwith

[11] Patent Number: 4,672,715

[45] Date of Patent: Jun. 16, 1987

[54] HINGE ASSEMBLY

[75] Inventor: John R. Beckwith, Rochester Hills, Mich.

[73] Assignee: General Motors Corporation, Detroit, Mich.

[21] Appl. No.: 755,150

[22] Filed: Jul. 15, 1985

[51] Int. Cl.[4] ..... E05D 11/10

[52] U.S. Cl. ..... 16/334; 16/375; 16/345

[58] Field of Search ..... 16/337, 342, 377, 375, 16/345, 321, 327, 334, 344, 85

[56] References Cited

U.S. PATENT DOCUMENTS

| | | | |
|---|---|---|---|
| 2,992,451 | 7/1961 | Schenitzer et al. | 16/327 |
| 3,550,185 | 12/1970 | Marchione | 16/85 X |
| 3,643,289 | 2/1972 | Lohr | 16/327 |
| 4,446,596 | 5/1984 | Arlauskas | 16/334 |

*Primary Examiner*—Donald R. Schran
*Assistant Examiner*—James L. Wolfe
*Attorney, Agent, or Firm*—Patrick M. Griffin

[57] ABSTRACT

An improved hinge assembly is provided that dampens the movement of a spring biased and notched hold open detent link pivoted to the door mounted hinge strap, thereby giving a smoother movement to that hinge strap, and consequently to the door. A molded dampening pad is fixed to the detent link with a surface adjacent to an edge of the detent link. A cam roller engageable with the detent link edge is pivoted on a stop pin fixed to the body mounted hinge strap. The stop pin has a cylindrical surface that is also adjacent to the detent link edge. As the cam roller rolls along the detent link and into the notches, the surface of the dampening pad engages the cylindrical surface of the stop pin to dampen the movement of the detent link.

3 Claims, 7 Drawing Figures

HINGE ASSEMBLY

This invention relates to hinges in general and specifically to an improved hinge assembly for use with a vehicle or the like.

BACKGROUND OF THE INVENTION

A hinge assembly is conventionally used to support a door on the body structure of a vehicle. Generally, such a hinge assembly includes a pair of pivotally connected hinge members or straps, a stationary hinge strap secured to the body structure and a movable hinge strap secured to the vehicle door. Often, the hinge assembly includes a hold open means designed to releasably hold the movable hinge member, and thus the vehicle door, in a plurality of discrete hold open positions. Generally, the hold open positions number two. A typical hold open means includes a detent link pivotally supported on the movable hinge strap. A relatively strong spring operatively connected to the detent link biases it toward a cam means supported on the stationary hinge strap. The cam means includes a cam roller that turns on the end of a stop pin fixed to the stationary hinge strap. The detent link includes an edge having a pair of spaced apart arcuate surfaces that define first and second detent notches.

As an operator opens the door from closed position, the spring keeps the edge of the pivoted detent link resiliently biased into the cam roller. The cam roller rolls along the edge of the detent link and forces the detent link about its pivot against the force of the spring. As the door continues to open, the cam roller rolls into the first detent notch, and the spring expands as the detent link moves back about its pivot. The force of the spring maintains the cam roller in the first detent notch, thereby releasably holding the movable hinge strap and the door in a first hold open position. As the operator opens the door further, the cam roller rolls out of the first detent notch, and again forces the detent link about its pivot against the force of the spring. The cam roller then rolls into the second detent notch, to similarly hold the movable hinge strap and door in a second hold open position. As the operator pulls the door back to the closed position, these motions of cam roller and detent link are reversed.

The spring used must necessarily be quite strong, especially in the case of a large and heavy door. Consequently, the force with which the cam roller rolls into the detent notch may be considerable. In addition, the angular interval covered by the door and hinge members between the hold open positions is not large, generally on the order of 20 degrees. Therefore, the movement of the detent link about its pivot as the cam roller rolls out of one detent notch and into another, and the simultaneous compression and expansion of the strong spring, may occur quite rapidly. Further, other portions of the detent link edge on which the cam roller rolls may be steeply sloped, especially the portion engaged as the door approaches its closed position. Again, because of the strong spring, the roller may be forced rapidly along those other portions of the detent link edge. These rapid and forceful motions of the detent link can cause a rough motion of the hinge member to which it is supported, and a consequent rough feel as perceived by the operator of the door.

SUMMARY OF THE INVENTION

The invention is disclosed in an improved hinge assembly that dampens the movement of the detent link described above.

A vehicle includes a body structure on which a door is supported by the improved hinge assembly for movement between closed and open positions. The hinge assembly includes a pair of hinge members, a movable hinge member securable to the vehicle door and a stationary hinge member securable to the vehicle body structure. The hinge members are pivotally connected for relative movement about a pivot axis between closed, open, and two hold open positions between the closed and open positions. The hinge assembly also includes a hold open means to releasably hold the movable hinge member, and thereby hold the door, in the hold open positions. The hold open means includes a detent member movably supported on one of the hinge members, which is a detent link pivotally supported on the movable hinge member in the embodiment disclosed. The detent link has an edge including arcuate surfaces that define first and second detent notches, which correspond to the hold open positions of the movable hinge member and door.

A cam means includes a first portion, a cam roller pivoted on a stop pin secured to the stationary hinge member. The cam roller is engageable with the edge of the detent link. A second portion of the cam means comprises a cylindrical surface of the stop pin that is adjacent to the detent link edge. A spring means carried by the movable hinge member includes a relatively strong spring operatively connected to the detent link so as to continually bias it about its pivot to keep the detent link edge engaged with the cam roller.

As an operator begins to open the door from the closed position, the cam roller begins to roll along the detent link edge. As the cam roller begins to roll, its engagement with the detent link rotates the detent link about its pivot and compresses the spring. The spring continues to compress until the cam roller is adjacent the leading edge of the first detent notch. At that point, the spring expands and moves the detent link back about its pivot and snaps the first detent notch into engagement with the cam roller. This engagement releasably holds the movable hinge member, and the vehicle door, in a first hold open position. Similarly, as the door is opened farther, the cam roller moves to the second detent notch, to hold the movable hinge member and door in a second hold open position. Because of the strength of the spring, the movement of the detent link described may cause a rough feel to the operator of the door at the hold open positions. Furthermore, in a conventional hinge assembly, as the door reaches the open position, a stop member on the movable hinge member is positioned so as to engage the stop pin. This engagement is uncushioned in a conventional hinge assembly. Also, that part of the detent link edge engaged by the cam roller as the door and movable hinge member are pulled toward the closed position is steeply sloped, and the cam roller may roll rapidly along it due to the force of the spring. The motion of the door may therefore also feel rough to the operator of the door at the final opening and closing.

The improvement of the invention serves to dampen the movement of the detent link, and thereby give a smoother movement to the movable hinge member and, consequently, to the door. A dampening pad of a suitable elastomer is secured with respect to the detent link, riveted therebeneath in the embodiment disclosed. The dampening pad has a surface adjacent the edge of the detent link that is frictionally engageable with the cylindrical surface of the stop pin described above. As the cam roller rolls into a detent notch, the surface dampening pad frictionally engages and is resiliently compressed by the cylindrical surface of the stop pin. This engagement dampens the movement of the detent link as the cam roller rolls into the detent notch, giving a smoother movement to the movable hinge member and door. In addition, the surface of the dampening pad frictionally engages the same cylindrical surface of the stop pin as the movable hinge member moves toward its open position and toward its closed position, thereby dampening the other rough feeling motions described above. The dampening pad in the embodiment disclosed may be easily combined with a conventional hinge assembly of the type described above. It cooperates with structure that is already present, the cylindrical surface of the stop pin, to give the advantage of the invention.

It is, therefore, an object of the invention to provide an improved hinge assembly for use with a vehicle having a door including a pair of pivotally connected hinge members, one securable to the vehicle body structure and one securable to the door so that the movable hinge member may move between a closed and a hold open position, and further having a hold open means to releasably hold the movable hinge member in its hold open position that includes a detent member with an edge including a detent notch movably supported on one hinge member and a cam means supported on the other hinge member having a first portion biased by a spring means into engagement with the detent member edge and with the detent notch at the hold open position, and in which the improvement comprises a second portion on the cam means adjacent the detent member edge and a dampening pad secured with respect to the detent member and having a surface also adjacent to the detent member edge and frictionally engageable with the second portion of the cam means, whereby the frictional engagement of the dampening pad surface and second portion of the cam means will dampen the movement of the detent member as the movable hinge member moves into its hold open position giving a smoother movement to the movable hinge member and, consequently, to the door.

It is another object of the invention to provide an improved hinge assembly of the type described in which the first portion of the cam means is a roller pivoted to a stop pin secured to the stationary hinge member and the second portion of the cam means is a cylindrical surface of the stop pin, with the surface of the dampening pad being frictionally engageable with the cylindrical surface of the stop pin to dampen the motion of the detent member as the movable hinge member moves into its hold open position.

It is yet another object of the invention to provide for use with a hinge assembly of the type described a dampening pad that may be secured to the detent member and has a surface that frictionally engages a second portion of the cam means to thereby dampen the motion of the detent member as the movable hinge member moves into its hold open position.

DESCRIPTION OF THE PREFERRED EMBODIMENT

These and other objects and features of the invention will appear from the following written description and drawings in which.

Figure 1:
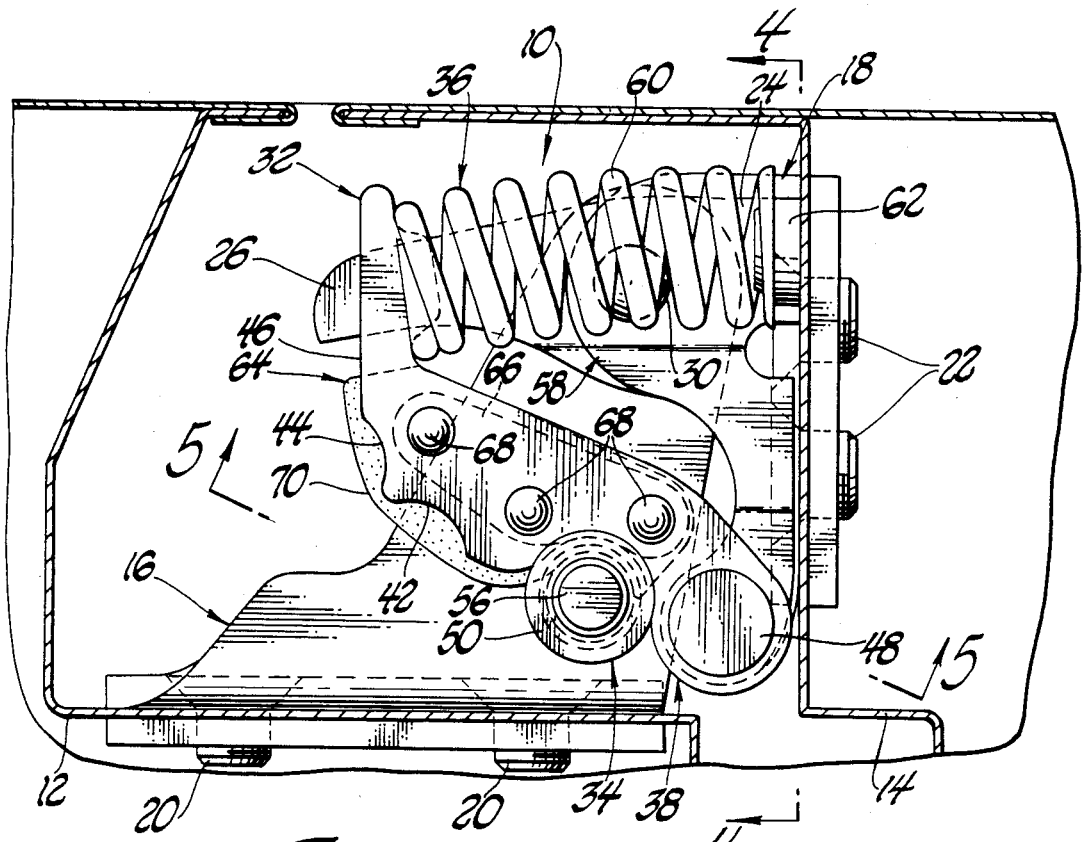
FIG. 1 is a plan view of the hinge assembly of the invention in closed position showing a vehicle body and door structure in cross section.

Referring first to FIG. 1, the preferred embodiment of the hinge assembly of the invention, designated generally at 10, is shown in place on a vehicle body structure 12 and a vehicle door 14. The hinge assembly 10 can be used with any vehicle door, but is disclosed as a hinge for a front passenger side door. Part of hinge assembly 10 is conventional, and will be first described. Hinge assembly 10 includes a pair of hinge members, a stationary hinge strap, designated generally at 16, and a movable hinge strap, designated generally at 18. Stationary hinge strap 16, as may be best seen in FIG. 4, is generally U-shaped and is conventionally secured to vehicle body structure 12 by bolts 20. Movable hinge strap 18 is also generally U-shaped and is secured to door 14 by bolts 22. Movable hinge strap 18 includes a top leg 24 that is downwardly bent and extends out to a free end 26, best seen in FIG. 1, which serves a purpose further described below. Stationary hinge strap 16 and movable hinge strap 18 are pivotally connected by primary lower and upper pivot assemblies 28 and 30 respectively. Primary pivot assemblies 28 and 30 are coaxial, and allow hinge straps 16 and 18 to rotate about a pivot axis between a closed position seen in FIG. 1, a pair of hold open positions seen in FIGS. 2 and 3, and a fully open position, not illustrated. Upper primary pivot assembly 30 also serves to join other structure to movable hinge strap 18, as will be described further below.

Figure 2:
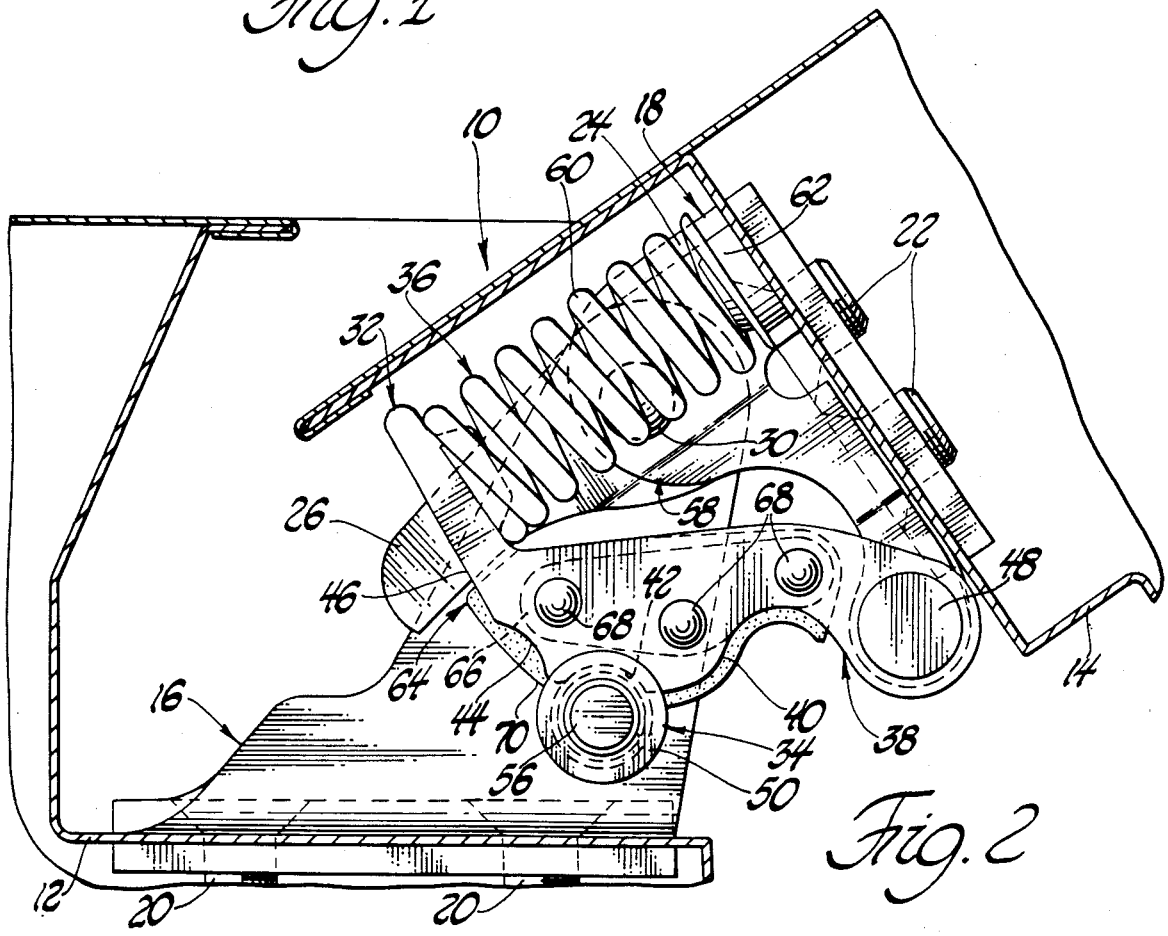
FIG. 2 is a view similar to FIG. 1, but showing the hinge assembly of the invention in a hold open position.
Figure 3:
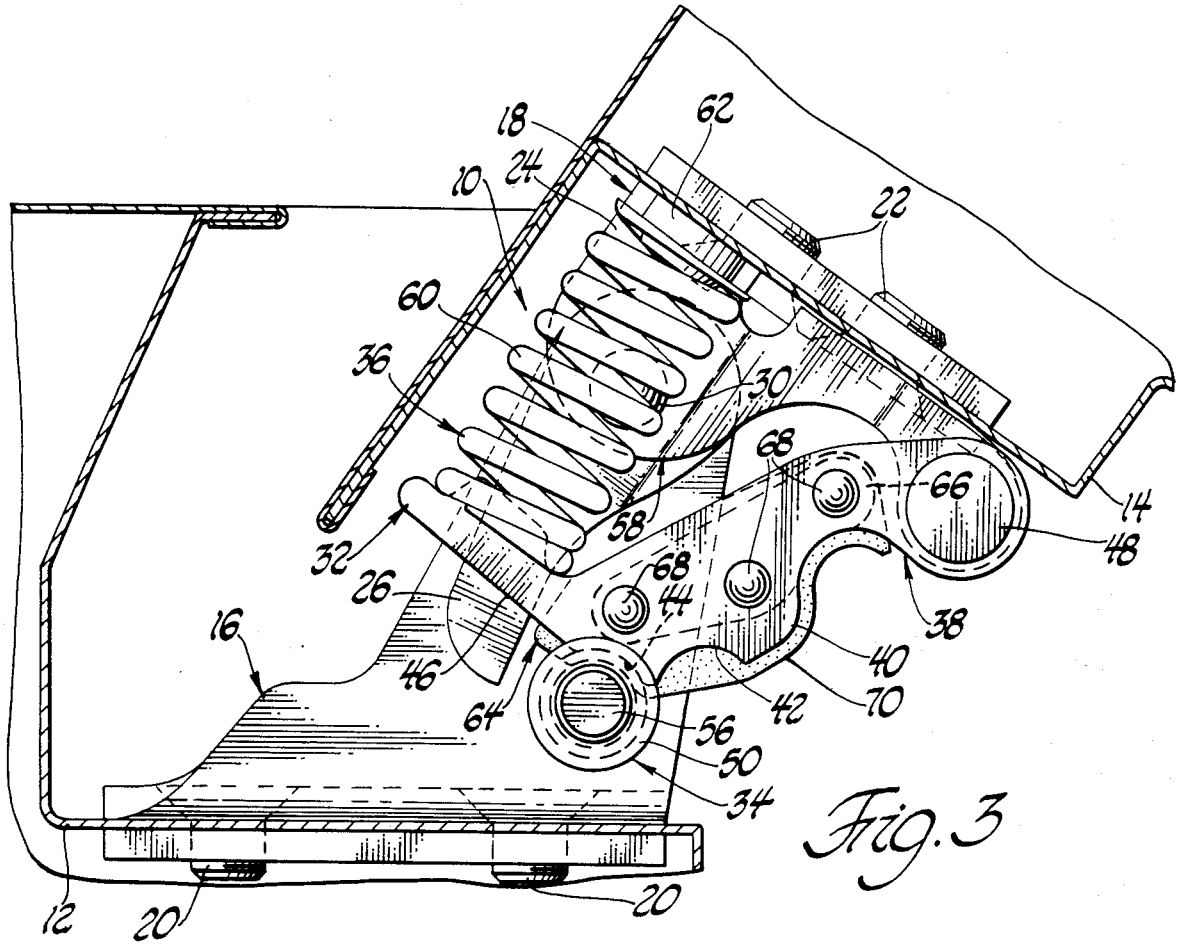
FIG. 3 is a view similar to FIG. 2, showing a further hold open position.
Figure 4:
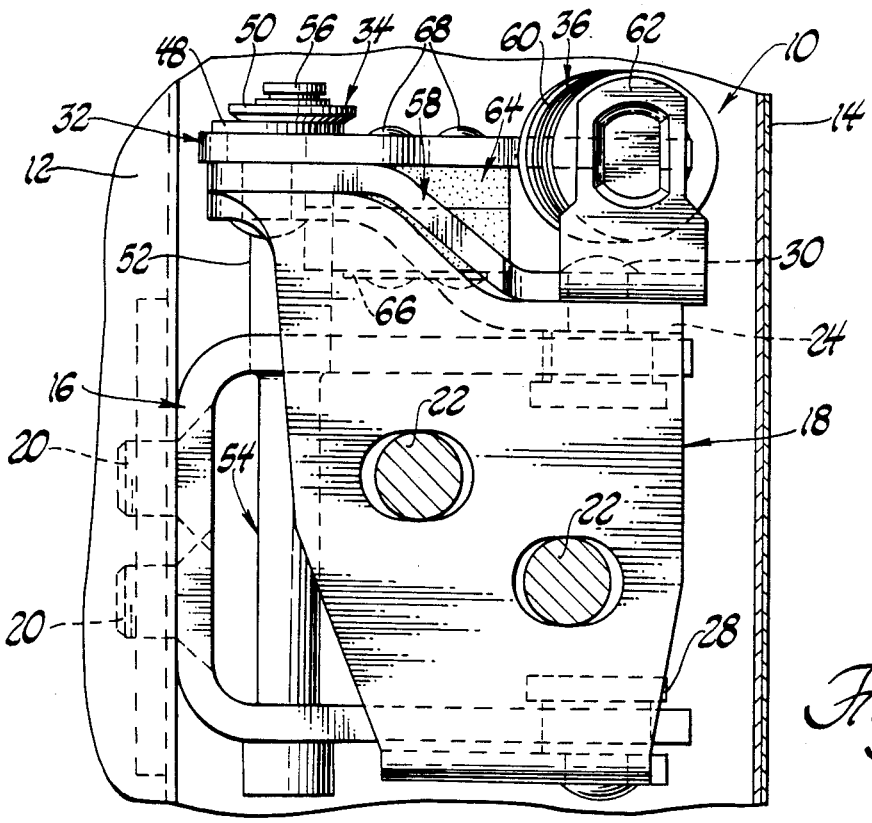
FIG. 4 is a view taken along the line 4—4 of FIG. 1.

Hinge assembly 10 also includes a hold open means that releasably holds movable hinge strap 18, and thus vehicle door 14, in the hold open positions of FIG. 2 and 3. Referring to FIG. 4, the hold open means consists basically of a detent member or link, designated generally at 32, a cam means designated generally at 34 and a spring means designated generally at 36. These will next be described in detail in order.

Figure 5:
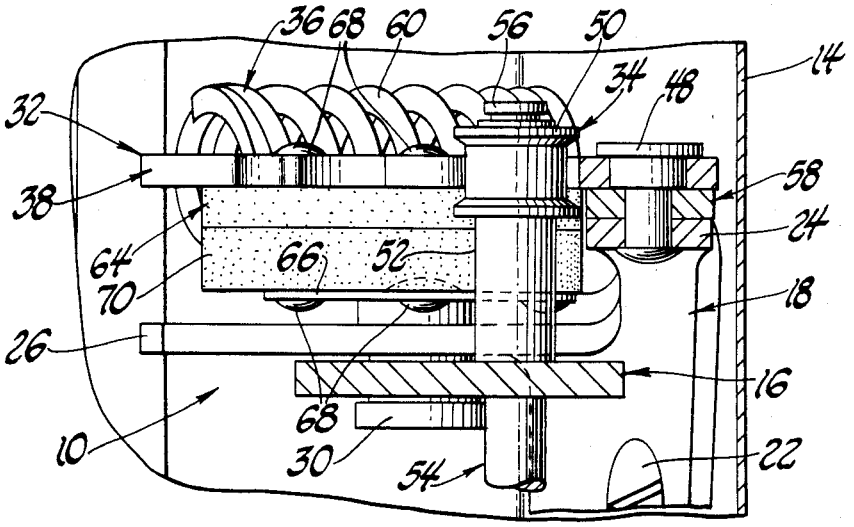
FIG. 5 is a view taken along the line 5—5 of FIG. 1.

Referring to FIG. 3, detent link 32 is a flat steel member having an edge designated generally at 38. Edge 38 includes an initial steeply sloped portion 40, a pair of arcuate surfaces that define first and second detent notches 42 and 44 respectively, and a final straight portion 46. Detent link 32 is movably supported on movable hinge strap 18 by a secondary pivot assembly 48 which passes through top leg 24 and through one end of detent link 32, as best seen in FIG. 5. Detent link 32 can thus pivotally move on movable hinge strap 18, although it moves only a few degrees. Secondary pivot assembly 48 also passes through other structure to be described below.

Referring next to FIGS. 4 and 5, cam means 34 includes a first portion comprising a cam roller 50 and a second portion comprising the upper cylindrical surface 52 of a stop pin designated generally at 54. Stop pin 54 is long enough to be secured through both legs of stationary hinge strap 16, for rigidity. Cam roller 50 is pivoted on the upper end of stop pin 54, held by a staking pin 56, and rolls along detent link edge 38. In a conventional hinge assembly, cylindrical surface 52, which lies adjacent to detent link edge 38, exists merely because cam roller 50 must be high enough above stationary hinge strap 16 to roll along detent link edge 38, for reasons discussed below.

Referring next to FIGS. 3 and 4, spring means 36 includes a spring support, designated generally at 58, and a coil compression spring 60. Spring support 58 is a steel stamping that is shaped to generally conform to the top leg 24 of movable hinge strap 18 and includes an upstanding flange 62. The upper primary pivot assembly 30 and the secondary pivot assembly 48 both pass through spring support 58 to fix it to top leg 24, as may be seen in FIGS. 4 and 5. Spring 60 is biased between spring support flange 62 and detent link 32 and keeps detent link edge 38 in engagement with cam roller 50. Spring 60 must be relatively strong, and its diameter will consequently be relatively large, for a heavy door 14. Top leg 24 is downwardly bent to accommodate that diameter. As a consequence, detent link 32 is located above hinge strap 16, which is where cam roller 50 must also be located, as noted above. Thus, cylindrical surface 52 results basically from considerations of spacing, and serves no purpose as such in a conventional hinge assembly. In the preferred embodiment 10, however, it cooperates with other structure to give the advantages of the invention.

The structure described thus far is representative of a conventional hinge assembly, the operation of which is described next. Starting from the closed position of FIG. 1, a door operator opens door 14 and movable hinge strap 18 pivots outward. Cam roller 50 rolls along detent link edge 38, initially rolling along the sloped portion 40. This engagement of cam roller 50 with detent link edge 38 causes detent link 32 to move about secondary pivot assembly 48, in opposition to and compressing spring 60. Cam roller 50 continues to roll along sloped portion 40 until it is adjacent first detent notch 42. Then, the compressed spring 60 expands and moves detent link 32 back about secondary pivot assembly 48, snapping the arcuate surface of first detent notch 42 into engagement with cam roller 50. This releasably holds movable hinge strap 18 and door 14 in the FIG. 2 position. Because of the strength of spring 60, the movement of detent link 32 can be rapid and forceful, causing a rough motion in movable hinge strap 18, and, consequently, in door 14. As the door operator continues to open door 14, cam roller 50 rolls from first detent notch 42 into the second detent notch 44, thus releasably holding movable hinge strap 18 and door 14 in a second hold open position, as seen in FIG. 3. Similarly, the movement of detent link 32 at the second hold open position may also cause a rough feel to the operator of the door 14.

Although not illustrated, the door 14 may be opened further, beyond the second hold open position. Further opening of door 14 rolls cam roller 50 out of second detent notch 44 and along the final straight portion 46 of detent link 38. Finally, free end 26 of movable hinge strap top leg 24 engages stop pin 54 to define a fully open position of movable hinge strap 18 and door 14. This engagement is uncushioned in a conventional hinge assembly, and may also feel rough to the door operator. The movement of cam roller 50 is reversed as the door operator pulls vehicle door 14 back toward the closed position of FIG. 1. However, during the final closing motion, as door 14 moves from the FIG. 2 to the FIG. 1 position, cam roller 50 rolls back along the steeply sloped portion 40 of detent link edge 38. The simultaneous expansion of spring 60 may cause cam roller 50 to move rapidly along sloped portion 40, which will consequently also feel rough to the door operator. Therefore, a conventional hinge assembly involves several areas of rough feeling motion, which the improvement of the invention deals with, described next.

Figure 6:
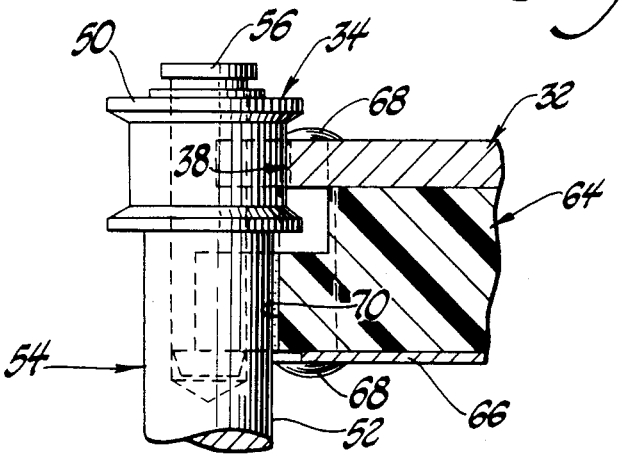
FIG. 6 is an enlarged view showing a portion of the cam means and a portion of the dampening pad in section as the movable hinge member moves between hold open positions.

A dampening pad, designated generally at 64, is fixed beneath the detent link 32, and vertically spaced therefrom, as best seen in FIG. 5. Dampening pad 64 is molded from a suitable material, such as a urethane elastomer, which has good resilience and wear characteristics. Dampening pad 64 is secured by any suitable means, such as the fastening plate 66 and rivets 68. Dampening pad 64 has a surface 70 that is adjacent to and beneath detent link edge 38, as may be easily seen in FIG. 6. Thus, dampening pad surface 70 is engageable with the cylindrical surface 52 of stop pin 54. The shape of dampening pad surface in comparison to detent link edge 38 may be best seen in FIGS. 1 and 2. A first portion of dampening pad surface 70, which is adjacent to the detent link edge sloped portion 40, generally matches its shape, and is horizontally spaced therefrom a constant amount. A second portion of dampening pad surface 70 which is adjacent the two detent notches 42 and 44 does not track their shape, and is spaced horizontally therefrom a greater amount. A third portion of dampening pad surface 70 which is adjacent detent link edge final straight portion 46, slopes slightly away therefrom as it approaches the free end 26 of top leg 24.

Figure 7:
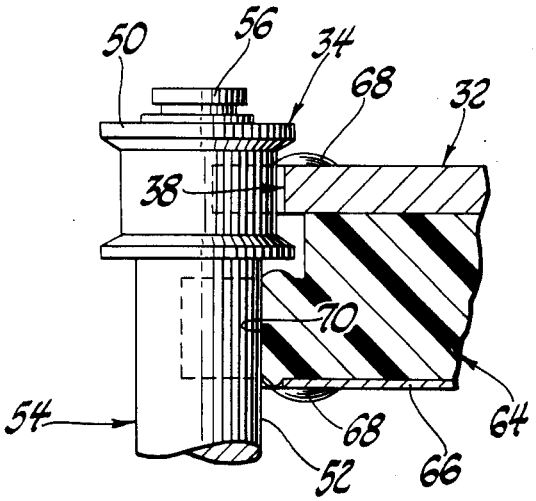
FIG. 7 is a view showing the structure of FIG. 6 when the movable hinge member is in a hold open position.

Dampening pad 64 cooperates with the cylindrical surface 52 of stop pin 54 to dampen the above described movement of detent link 32. As the door operator moves door 14 and movable hinge strap 18 from the FIG. 1 closed position toward the FIG. 2 first hold open position, the dampening surface 70 lightly frictionally engages the cylindrical surface 52. This frictional engagement is not enough to significantly affect the force necessary to open door 14. As cam roller 50 moves just adjacent first detent notch 42, cylindrical surface 52 moves slightly away from dampening pad surface 70, as may be seen in FIG. 6. Then, as cam roller 50 move into first detent notch 42, cylindrical surface 52 frictionally engages the surface 70 more heavily, sinking into and compressing it, as may be seen in FIG. 2 and 7. This compression of dampening pad 64 serves to dampen and cushion the motion of detent link 32, consequently smoothing out the movement of movable hinge strap 18 to alleviate the rough feeling motion of door 14 described above. As door 14 is opened farther, cam roller 50 rolls out of the first detent notch 42 and the dampening pad surface 70 again moves slightly away from cylindrical surface 52, just as in FIG. 6. At the FIG. 3 hold open position of movable hinge strap 18 and door 14, dampening pad surface is also compressed by cylindrical surface 52, and movement of detent link 32 is similarly damped and cushioned. Since this dampening action is identical for both the FIGS. 2 and 3 hold open positions, FIGS. 6 and 7 adequately illustrate both positions.

Although not illustrated, as the door 14 and movable hinge strap 18 were moved from the FIG. 3 second hold open position toward a fully open position, cam roller 50 would roll along detent link edge final straight portion 46. Simultaneously, cylindrical surface 52 would frictionally engage and slightly compress the final portion of dampening pad surface 70. This would cushion the engagement of free end 26 with stop pin 54 that defines the fully open position. The just described dampening action reoccurs as door 14 is pulled back toward the closed position of FIG. 1. In addition, as the door is pulled closed from the FIG. 2 first hold open position, the frictional engagement of cylindrical surface 52 with dampening pad surface 70 serves to dampen the otherwise rapid motion of cam roller 50 along detent link edge sloped portion 40 described above, improving the feel of the final closing motion of door 14.

The invention is broad enough to encompass the cooperation of any second portion of a cam means with the surface of a dampening pad. Other specific structures for the cam means, detent member and spring means could be substituted. Practically, it is advantageous to provide a dampening pad 64 as illustrated that can be easily combined with and cooperate with an existing conventional hinge assembly, and the invention encompasses that as well. The dampening pad 64 and detent link 32 could be structurally combined as a subassembly, if desired. A dampening pad with a surface large enough only to dampen the movement of the detent link at the hold open positions would take care of the worst of the rough feeling motions described. It is desirable, however, to also dampen the other rough feeling motions described. Dampening pad surface 70 may, of course, be altered to increase or lessen the amount of frictional engagement and compression thereof. Therefore, it will be understood that the invention is capable of being embodied in structures within the scope of this invention other than those disclosed, and is not intended to be so limited.

The embodiments of the invention in which an exclusive property or privilege is claimed are defined as follows:

1. In an improved hinge assembly for use with an automotive vehicle or the like having a door supported by said hinge assembly on a body structure for movement between closed and open positions, said hinge assembly including a stationary hinge member adapted to be secured to said body structure, a movable hinge member adapted to be secured to said door, means pivotally connecting said movable hinge member to said stationary hinge member for movement about a pivot axis between closed and at least one hold open position, hold open means for releasably holding said movable hinge member in said hold open position, said hold open means including a detent member movably supported on one hinge member and having an edge including an arcuate surface that defines a detent notch, cam means supported by the other hinge member, and movable relative to said detent member as said movable hinge member moves about said pivot axis, said cam means including a first portion engageable with said detent member edge, and spring means carried by said one hinge member and operatively connected to said detent member to bias said detent member edge into engagement with said cam means first portion, the engagement of said cam means first portion with said detent member edge moving said detent member in opposition to the biasing force of said spring means as said cam means moves relative to said detent member as said movable hinge member approaches its hold open position until said cam means first portion is adjacent said detent notch, whereupon said spring means moves said detent notch arcuate surface into engagement with said cam means first portion to releasably hold said movable hinge member in its hold open position, the improvement comprising;

an elastomer dampening pad secured to said detent member and having a surface adjacent to and vertically spaced from said detent member edge, said dampening pad surface further having a first portion that is horizontally spaced from and generally matches the shape of said detent edge and a second portion adjacent to said detent notch that is horizontally spaced from said detent member edge by a greater amount than said first dampening pad portion, and, a second portion on said cam means adjacent to and vertically spaced from said detent member edge that is lightly frictionally engageable with said dampening pad surface first portion, said cam means second portion sinking into and compressing said dampening pad surface second portion when said movable hinge member moves into its hold open position, thereby dampening and cushioning the movement of said detent member so that a smoother movement of said hinge member is obtained.

2. In an improved hinge assembly for use with an automotive vehicle or the like having a door supported by said hinge assembly on a body structure for movement between closed and open positions, said hinge assembly including a stationary hinge member adapted to be secured to said body structure, a movable hinge member adapted to be secured to said door, means pivotally connecting said movable hinge member to said stationary hinge member for movement about a pivot axis between closed and at least one hold open position, hold open means for releasably holding said movable hinge member in said hold open position, said hold open means including a detent member movably supported on one hinge member and having an edge including an arcuate surface that defines a detent notch, cam means supported by the other hinge member, and movable relative to said detent member as said movable hinge member moves about said pivot axis, said cam means including a cam roller pivoted to a stop pin secured to said other hinge member and engageable with said detent member edge, and spring means carried by said one hinge member and operatively connected to said detent member to bias said detent member edge into engagement with said cam roller, the engagement of said cam roller with said detent member edge moving said detent member in opposition to the biasing force of said spring means as said cam means moves relative to said detent member as said movable hinge member approaches its hold open position until said cam roller is adjacent said detent notch, whereupon said spring means moves said detent notch arcuate surface into engagement with said cam roller to releasably hold said movable hinge member in its hold open position, the improvement comprising;

an elastomer dampening pad secured to said detent member and having a surface adjacent to and vertically spaced from said detent member edge, said dampening pad surface further having a first portion is horizontally spaced from and generally matches the shape of said detent edge and a second portion adjacent to said detent notch that is horizontally spaced from said detent member edge by a greater amount than said first dampening pad portion, and, a cylindrical surface on said stop pin adjacent to and vertically spaced from said detent member edge that is lightly frictionally engageable with said dampening pad surface first portion, said stop pin cylindrical surface sinking into and compressing said dampening pad surface second portion when said movable hinge member moves into its hold open position, thereby dampening and cushioning the movement of said detent member so that a smoother movement of said hinge member is obtained.

3. For use with a hinge assembly for an automotive vehicle or the like having a door supported by said hinge assembly on a body structure for movement between closed and open positions, said hinge assembly including a stationary hinge member adapted to be secured to said body structure, a movable hinge member adapted to be secured to said door, means pivotally connecting said movable hinge member to said stationary hinge member for movement about a pivot axis between closed and at least one hold open position, hold open means for releasably holding said movable hinge member in said hold open position, said hold open means including a detent member movably supported on one hinge member and having an edge including an arcuate surface that defines a detent notch, cam means supported by the other hinge member, and movable relative to said detent member as said movable hinge member moves about said pivot axis, said cam means including a first portion engagable with said detent member edge and a second portion adjacent to and vertically spaced from said detent member edge, and spring means carried by said one hinge member and operatively connected to said detent member to bias said detent member edge into engagement with said cam means first portion, the engagement of said cam means first portion with said detent member edge moving said detent member in opposition to the biasing force of said spring means as said cam means moves relative to said detent member as said movable hinge member approaches its hold open position until said cam means first portion is adjacent said detent notch, whereupon said spring means moves said detent notch arcuate surface into engagement with said cam means first portion to releasably hold said movable hinge member in its hold open position, the invention comprising;

an elastomer dampening pad securable to said detent member and having a surface adjacent to and vertically spaced from said detent member edge when so secured, said dampening pad surface further having a first portion that is horizontally spaced from and generally matches the shape of said detent edge and a second portion adjacent to said detent notch that is horizontally spaced from said detent member edge by a greater amount than said first dampening pad portion, with said dampening pad surface first portion being lightly frictionally engagable with said cam means second portion, said cam means second portion sinking into and compressing said dampening pad surface second portion when said movable hinge member moves into its hold open position, thereby dampening the movement of said detent member so that a smoother movement of said hinge member is obtained.

* * * * *